US008201828B2

(12) United States Patent
Curry et al.

(10) Patent No.: US 8,201,828 B2
(45) Date of Patent: Jun. 19, 2012

(54) WAGERING GAME BASED ON BAYES' THEOREM

(76) Inventors: Scott Curry, San Marcos, CA (US); Rich Dicker, San Diego, CA (US)

( * ) Notice: Subject to any disclaimer, the term of this patent is extended or adjusted under 35 U.S.C. 154(b) by 104 days.

(21) Appl. No.: 12/617,467

(22) Filed: Nov. 12, 2009

(65) Prior Publication Data

US 2011/0109043 A1 May 12, 2011

(51) Int. Cl.
*A63F 1/18* (2006.01)

(52) U.S. Cl. ..... 273/274; 273/292

(58) Field of Classification Search ..... 273/274, 273/292, 138.1, 139; 463/16–25, 29
See application file for complete search history.

(56) References Cited

U.S. PATENT DOCUMENTS 6,695,311 B2 * 2/2004 Yu et al. ..... 273/273
6,811,483 B1 * 11/2004 Webb et al. ..... 463/16
7,364,159 B2 * 4/2008 Berman et al. ..... 273/138.1
7,559,836 B2 7/2009 Gerson et al.
7,887,412 B2 * 2/2011 Baerlocher ..... 463/25
7,942,734 B2 * 5/2011 Alderucci et al. ..... 463/21
2008/0146311 A1 * 6/2008 Walker et al. ..... 463/20
2010/0203940 A1 * 8/2010 Alderucci et al. ..... 463/16
2010/0203953 A1 * 8/2010 Alderucci et al. ..... 463/25

* cited by examiner

*Primary Examiner* — William Pierce
(74) *Attorney, Agent, or Firm* — Muskin & Cusick LLC

(57) ABSTRACT

A method to implement a casino card game. After the player places an ante wager, the dealer can deal three cards and the player selects a player selected card and the dealer randomly selects a dealer selected card. The goal for both the player and the dealer is to pick the highest (or strongest) card. The dealer will then reveal the lowest (or weakest) of the two remaining cards that are not the dealer selected card. The player can then place an optional raise wager, and the dealer may randomly switch the dealer selected card. All three cards are then revealed, and if the player picked the highest (strongest) card and the dealer did not pick the highest (strongest) card, then the player wins a payout on the ante wager and any raise wager placed. If the dealer picked the highest (strongest) card and the player did not pick the highest (strongest) card, then the player loses his or her ante wager and any raise wager placed.

18 Claims, 7 Drawing Sheets

WAGERING GAME BASED ON BAYES' THEOREM

BACKGROUND OF THE INVENTION

1. Field of the Invention

The present general inventive concept is directed to a method, apparatus, and computer readable storage medium directed to a wagering game.

2. Description of the Related Art

The "Monty Hall Problem" is a math exercise based on the American television game show "Let's Make a Deal." The problem can generally be stated as follows, suppose you are on a game show and you are given the choice of three doors. Behind one of the doors is a car while behind each of the other two doors is a goat. You choose a door at random, and then the host must open one of the two remaining doors and must open a door which has a goat behind it. You now have the choice whether to keep your current door or switch to the remaining door. Is it in your advantage to switch?

Intuitively, one's answer to the problem is that switching should not matter, but in reality, to keep your initial choice of doors results in a probability of 1/3 of getting the car, while switching results in a probability of 2/3 of getting the car. Therefore, the contestant should always switch.

The problem can be solved by Bayes' theorem, which expresses the posterior probability (i.e. after evidence E is observed) of a hypothesis H in terms of the prior probabilities of H and E, and the probability of E given H. As applied to the Monty Hall problem, once information is known about what is behind another door, the probabilities of both the originally chosen door and the remaining door are no longer equal.

Many people have enjoyed watching "Let's Make a Deal" and particular the ending sequence when contestants get to pick a door. In addition, the mathematics of the problem and its paradoxical nature has captured the imagination of the public and has been written about numerous times in magazines, journals, and textbooks.

Casino wagering games are a billion dollar industry in the United States, and such games commonly require players to bet on random occurrences.

What is needed is a casino game that can apply Bayes' theorem such that the game could capture the interest of the casino patrons and generate excitement. Such a game would be exciting and enjoyable for the players as well as profitable for the casino offering the game.

SUMMARY OF THE INVENTION

It is an aspect of the present invention to provide an exciting casino wagering game.

The above aspects can be obtained by (a) providing a physical deck(s) of cards; (b) receiving a main wager from a player; (c) dealing a plurality of initial cards face down from the physical deck(s) of cards; (d) receiving, from the player, a selection of a player selected card out of the plurality of initial cards; (e) determining randomly and identifying a dealer selected card out of the plurality of initial cards; (f) revealing a revealed card, the revealed card being a weaker card among the plurality of initial cards that are not the dealer selected card; (g) determining randomly whether to switch the dealer selected card to another unrevealed card among the plurality initial cards; (h) revealing all of the plurality of initial cards; (i) determining whether the player selected card is a strongest card out of the plurality of initial cards and whether the dealer selected card is not the strongest card out of the plurality of initial cards, and if both previous conditions are true then paying the main wager as a winning wager for the player.

The above aspects can also be obtained by an apparatus that includes (a) a processing unit, performing: (i) receiving a main wager from a player; (ii) dealing a plurality of initial cards face down from the physical deck(s) of cards; (iii) receiving, from the player, a selection of a player selected card out of the plurality of initial cards; (iv) determining randomly and identifying a dealer selected card out of the plurality of initial cards; (v) revealing a revealed card, the revealed card being a weaker card among the plurality of initial cards that are not the dealer selected card; (vi) determining randomly whether to switch the dealer selected card to another unrevealed card among the plurality initial cards; (vii) revealing all of the plurality of initial cards; (viii) determining whether the player selected card is a strongest card out of the plurality of initial cards and whether the dealer selected card is not the strongest card out of the plurality of initial cards, and if both previous conditions are true then paying the main wager as a winning wager for the player; and (b) an output device outputting results of the processing unit.

These together with other aspects and advantages which will be subsequently apparent, reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

Further features and advantages of the present invention, as well as the structure and operation of various embodiments of the present invention, will become apparent and more readily appreciated from the following description of the preferred embodiments, taken in conjunction with the accompanying drawings of which.

DESCRIPTION OF THE PREFERRED EMBODIMENTS

Figure 1:
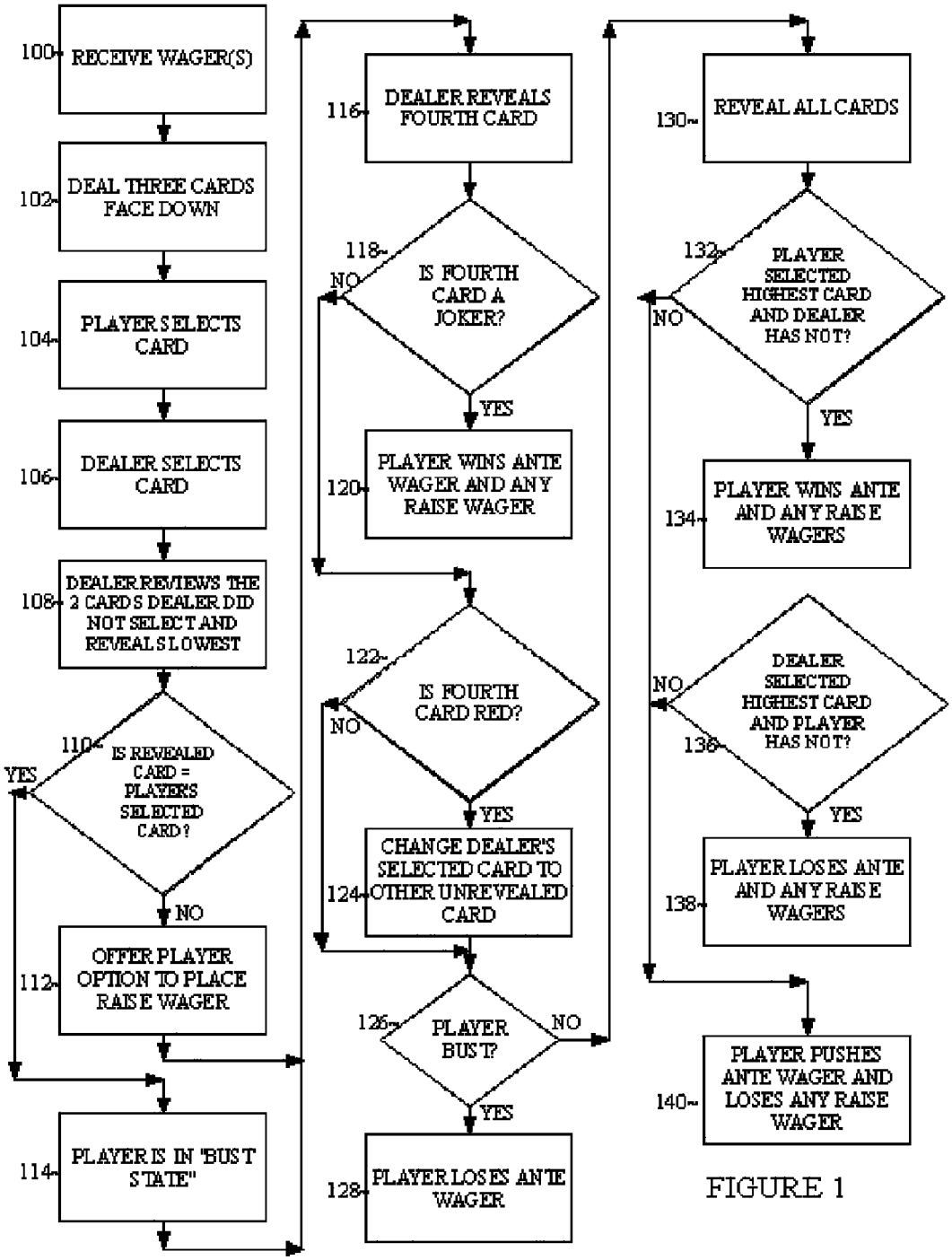
FIG. 1 is a flowchart illustrating an exemplary method of implementing a wagering game, according to an embodiment.

Reference will now be made in detail to the presently preferred embodiments of the invention, examples of which are illustrated in the accompanying drawings, wherein like reference numerals refer to like elements throughout.

The present inventive concept relates to a method, apparatus, and computer readable storage medium to implement a casino wagering card game. The player's goal in the game is to pick the highest card out of three cards. Cards are dealt face down and their values are not known to the player until they are turned face up. After the player picks a card, the dealer also picks a card at random, and the lower of the remaining cards not picked by the dealer is revealed. The player has the ability (in some circumstances) to place a raise wager, which the player would likely make if the player was confident his card is the highest card out of the three cards. All of the card values are ultimately revealed to the player, and if the player has picked correctly and the dealer has picked incorrectly the player has won the game (and wins a respective monetary payouts).

The game can be dealt with a standard deck of 52 cards along with 2 jokers (one black, one red). Cards can be ranked from deuce (lowest) to ace (highest) followed by the joker. Ties are broken by suits, wherein suits can be ranked from clubs (lowest), diamonds, hearts, spades (highest). Between the two jokers, the black joker outranks the red joker. In other embodiments, other kinds of decks can be used such as a standard 52 card deck (no jokers), Spanish deck, short deck, etc. In addition to a single deck, the game can be dealt using multiple decks as well.

FIG. 1 is a flowchart illustrating an exemplary method of implementing a wagering game, according to an embodiment.

The method can begin with operation 100, which receives an ante wager from a player. This can be done as known in the art, for example, the player places chip(s) on a betting circle on a standard gaming table.

Side wagers can be placed as well in operation 100. For example, a poker side wager can be placed which after all four cards are revealed (the three initial cards and the action card), can be resolved based on a poker rank of the four cards (see Table I). An action card side wager can be placed which can be resolved based on characteristics of the single action card, such as whether it will be a red suit, black suit, or joker (see Table II).

A further conditional five card poker side bet can be offered. This side bet works similarly to the four card poker side bet described above and pays on the four card hand, with the exception that if the four revealed cards comprise one of: a) four of a kind; b) 4 to a straight flush, then a fifth card will be dealt which can then be used to see if a five of a kind (since the deck can use jokers) or 5-card straight flush is made, which then pay higher amounts. If the fifth card does not make 5 of a kind or a 5-card straight flush, then the fifth card is ignored and the payout (if any) is made based on the four original cards.

Figure 2A:
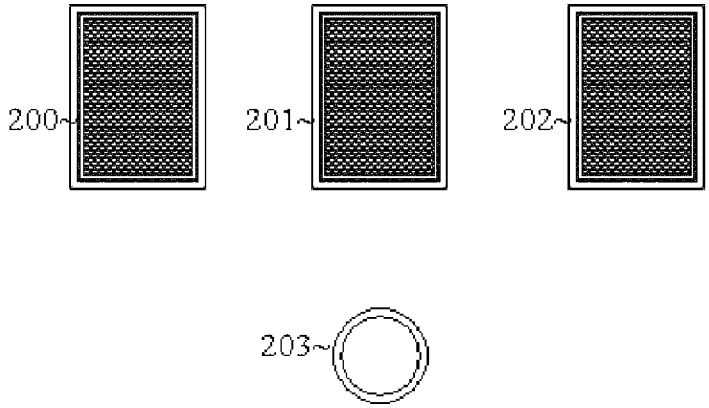
FIG. 2A is a drawing illustrated a first phase of an illustrative game, according to an embodiment.

FIG. 2A is a drawing illustrated a first phase of an illustrative game, according to an embodiment.

From operation 100, the method proceeds to operation 102, which deals three cards face down. In other embodiments, other numbers of cards besides three can be used (e.g., 4 and higher). These cards can be considered the "initial cards" and comprise the cards that the player and dealer can select.

From operation 102, the method proceeds to operation 104, wherein the player can select a player selected card from the cards dealt in operation 102. The player can select his or her card by simply pointing to the card the player wishes to select. The dealer can indicate which card is the player selected card by using a marker (or lamer, etc.) which is placed in a physical location relative to the player selected card. Instead of using a lamer, in another embodiment, each player can have three betting circles, one betting circle for each respective card, and the player places their ante wager in the betting circle corresponding to the card the player wishes to select (which becomes the player selected card), see FIGS. 6B and 6C.

From operation 104, the method proceeds to operation 106, wherein the dealer selects a dealer selected card out of the cards dealt in operation 102. The dealer selected card is selected at random and can be determined using any random number generator (e.g., dice, wheel, top, electronic random number generator, mental determination of the dealer, etc.) For example, if a standard die is used, the numbers 1, 2 can correspond to the first card dealt, numbers 3, 4 can correspond to the second (middle) card dealt, and the numbers 5, 6 can correspond to the third card dealt. Thus, the die can be rolled and the dealer's selected card is determined using the result of the die. Once the dealer selected card is determined, a marker (or lamer, etc.) can be used to indicate to everyone involved in the game which card is the dealer selected card. The dealer selected card can be the same card as the player selected card, but it of course would not always be.

From operation 106, the method proceeds to operation 108, wherein the dealer looks at the remaining cards (two cards) and determines which of these cards is the lowest, and then reveals (turns over) the lowest card. While the dealer now knows the value of the unrevealed remaining card, the dealer would typically not share this information with anyone.

From operation 108, the method proceeds to operation 110, which determines whether the revealed card (from operation 108) is the same card as the player's selected card. If so, then the method proceeds to operation 114, which proceeds to operation 114 and designates the player's game state as a "bust state." This is generally not good for the player and the player can typically only win in operation 120 if a fourth card revealed turns out to be a joker. The method then continues to operation 116.

If the determination in operation 110 determines that the revealed card is not equal to the player's selected card, then the method proceeds to operation 112, which offers the player the option to place a raise wager. The raise wager can be an amount chosen by the player up to double the amount of the ante wager placed in operation 100, or in an alternative embodiment the raise wager must be equal in amount to double the ante wager placed in operation 100. If the player chooses to place the raise wager then he places the raise wager by placing a respective amount of chips on the gaming table. If the player chooses not to make the raise wager, then he can simply omit to place the raise wager. In either case, the game proceeds. The optimal strategy for the player, based on the rules illustrated in FIG. 1, is when the revealed card is at least five of diamonds and the player selected card and the dealer selected card are not the same card, then the player should raise an amount equal to two times (double) the ante wager. If the player selected card and the dealer selected card are the same card, then the player optimally should not raise. Using this strategy, the house will win, on average, 1.22% of the ante wager.

From either operation 112 or 114, the method continues to operation 116, wherein the dealer reveals a fourth card. The fourth card could have already been dealt face down (at operation 102 or at another point) and now it is turned face up, or the fourth card can now be dealt from a shoe (or deck) face up. The fourth card can also be referred to as the "action card." The action card is use to determine action taken in the game but cannot be selected by the player or the dealer as the selected card and is not compared with the three initial cards in order to determine the highest card.

From operation 116, the method proceeds to operation 118, which determines whether the fourth card ("action card") is a joker. If the fourth card is a joker, then the method proceeds to operation 120, wherein the player wins the ante wager (placed in operation 100) and any raise wager placed (in operation 112). Here the game ends. The operation does not require a joker to be the triggering condition, and other cards or conditions can be used as well (e.g., if the fourth card is an ace instead of a joker). The latter can be used in an embodiment of the game that does not use jokers.

If in operation 118, it is determined that the fourth card is not a joker, then the method proceeds to operation 122 which determines whether the fourth card meets a predefined characteristic, for example whether the fourth card is red. In other embodiments, operation 122 can determine if the fourth card is black, if the fourth card is a particular suit (e.g., hearts), a particular rank or range of ranks, etc.

If in operation 118 determines that the fourth card is red, the method proceeds to operation 124 which changes the dealer's selected card (selected in operation 106) to the other unrevealed card from operation 108 (in other words the other card that the dealer did not select in operation 106 that is unrevealed). The method then proceeds to operation 126.

It is noted that in other embodiments, other mechanisms can be used to determine whether the dealer switches the dealer selected card than using an action card. For example, other random number generators can be used (e.g., dice, electronic, a coin flip, etc) which can determine whether a switch is made or not.

If from operation 122, it is determined that the fourth card is not red, then the method proceeds to operation 126, which determines whether the player has busted (has reached operation 114). If the player has busted, then the method proceeds to operation 128, wherein the player loses the ante wager and the game ends. If all current players at the table have busted, then in an embodiment, operations 122-124 can be skipped since they would be irrelevant to resolving the wagers.

If the player has not busted, then from operation 126 the method proceeds to operation 130, which reveals all cards (all cards still unrevealed dealt in operation 102). Once all the cards are revealed, it can now be determined who the winner is.

From operation 130, the method proceeds to operation 132, which determines if the player selected the highest card out of the three cards (dealt in operation 102) and the dealer's selected card is not the highest card out of the three cards (dealt in operation 102). If this is true, then the method proceeds to operation 134, wherein the player has won the game and the player wins respective payouts on the ante wager and raise wager (if placed). The player has won the game because the player has successfully chosen the highest card while the dealer has not. The winning payout on the ante wager and the raise wager is 2:1, although this payout can be different in other embodiments. Here the game ends.

If both of the conditions from operation 132 are not true, then the method proceeds to operation 136, which determines if the dealer's selected card is the highest card out of the cards dealt in operation 102 and the player's selected card is not the highest card out of the cards dealt in operation 102. If both conditions are true, then the method proceeds to operation 138, wherein the player has lost. The player loses because the dealer has successfully selected the highest card while the player has not. Thus, the player loses his or her ante wager and any raise wager the player has placed, and the game ends.

If both conditions in operation 136 are not true, then the method proceeds to operation 140, wherein the player pushes on the ante wager and loses any raise wager placed. The game ends here, as neither the player or the dealer are considered the winner.

It is noted that the operations and determinations in FIG. 1 can be performed in any order that does not upset the fundamental operation of the game. For example, the determinations 132 and 136 can be performed in reverse order. Or the determination in operation 126 can be performed before operation 122 instead of afterwards. In another embodiment, cards can be dealt as they are revealed, in other words, cards are only dealt when it is time to review (by the dealer) or reveal them. As another example, operations 104 and 106 can be switched. These are merely examples, and it can be appreciated that numerous permutations and variants of the method can be implemented. Also, different characteristics of the card values can be used as well in order to take actions, and the ones enumerated herein are merely examples. For example, instead of using a red action card in operation 122 to determine whether the switch the dealer's selected card or not, the rank of the card could be used, e.g., if the action card is A-6 the dealer switches while 7-K the dealer does not switch, (which would change the mathematics of the game since the dealer would not have an equal probability of switching).

Side wagers can all be resolved when game play has ended. For example, in operations 120, 128, 134, 138, and 140, in addition to resolve the ante wager and any raise wager placed, all side wagers placed can be resolved based on the predefined characteristics of such side wagers.

Table I below is an exemplary paytable for the poker side wager. The player places single poker side wager which pays on any of the winning payouts in Table II. The house edge for the poker side wager using the payouts in Table I is 5.41%.

TABLE I

| Hand | Payout |
|---|---|
| Pair 10's-Q's | 1:1 |
| Pair K's-A's | 3:2 |
| Two Pair | 2:1 |
| Straight | 4:1 |
| Flush | 10:1 |
| Three of a Kind | 3:1 |
| Straight Flush | 25:1 |
| Four of a Kind | 100:1 |
| All else | lose |

Table II below is an exemplary paytable of the action side wager. Note that for the action side wager, the player chooses to place the bet on red, black, or joker (and there are three betting circles for each bet). The player can choose to bet on zero (the bet is optional), one, two, or all three of the action side wagers. The house edge for each of the action side wagers is 3.70%. Note that a red action card is a heart or diamond, while a black action card is a club or spade.

TABLE II

| Hand | Payout |
|---|---|
| Red | 1:1 |
| Black | 1:1 |
| Joker | 25:1 |
| All else | lose |

In further embodiments, different relationships can be used in order to effectuate the game. For example, while the game in FIG. 1 illustrates the object of trying to pick the highest card, in an alternative embodiment, the player's and dealer's objective in order to win would be to pick the lowest card. In the game where the objective is to pick the highest card, a higher card can be considered "stronger" than a lower card, while the lower card can be considered "weaker." This is because the higher card beats the lower card. In the embodiment where the goal is to pick the lowest card, a lower card can be considered "stronger" than a higher card, while the higher card can be considered "weaker." This is because the lower card beats the higher card. Other relationships can be used to determine the winner as well.

An exemplary game will now be presented for illustrative purposes, however of course it can be appreciated that this is just one example and millions of other individual game identities can occur.

FIG. 2A is a drawing illustrated a first phase of an illustrative game, according to an embodiment.

The game can start by the player placing an ante wager 203 (in operation 100) and dealing three cards face down 200, 201, 202 without anyone (player or dealer) viewing the cards (operation 102).

Figure 2B:
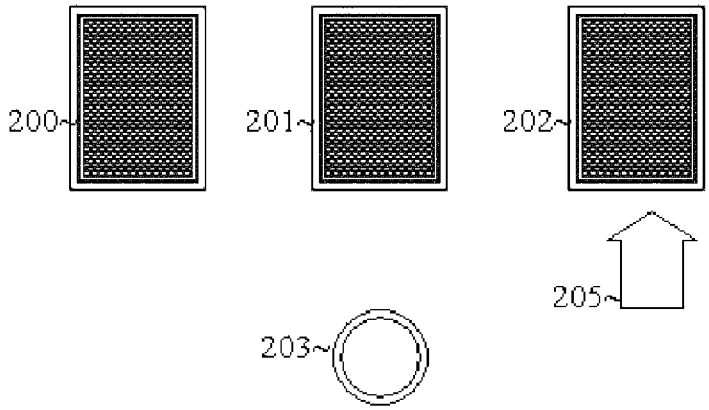
FIG. 2B is a drawing illustrated a second phase of an illustrative game, according to an embodiment.

FIG. 2B is a drawing illustrated a second phase of an illustrative game, according to an embodiment.

The player then chooses which of the three cards is the player selected card (operation 104). In this example, the player chooses the rightmost card 202, and a player marker 205 is placed by the dealer indicating which is the player selected card.

Figure 3A:
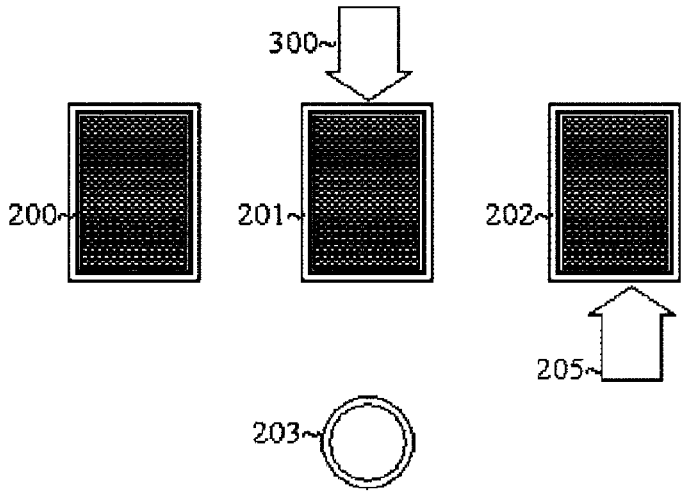
FIG. 3A is a drawing illustrated a third phase of an illustrative game, according to an embodiment.

FIG. 3A is a drawing illustrated a third phase of an illustrative game, according to an embodiment.

The dealer then chooses randomly which of the three cards is the dealer selected card (operation 106), and in this example the dealer chooses the middle card 201. A dealer marker 300 is placed by the dealer indicating which card is the dealer selected card.

Figure 3B:
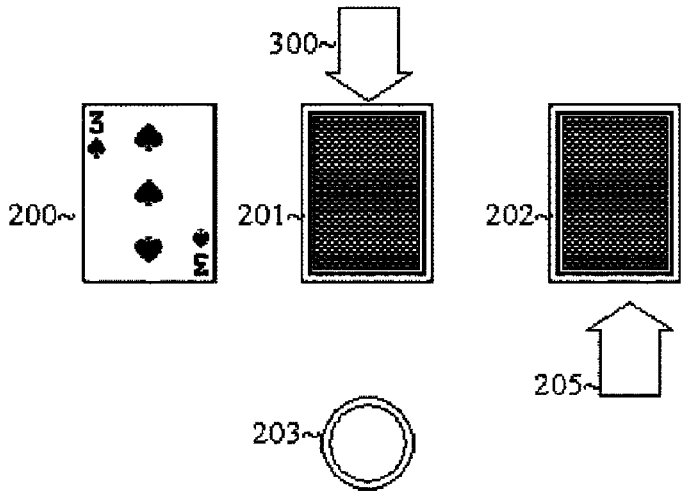
FIG. 3B is a drawing illustrated a fourth phase of an illustrative game, according to an embodiment.

FIG. 3B is a drawing illustrated a fourth phase of an illustrative game, according to an embodiment.

The dealer then peeks (operation 108) without the player seeing the contents of the two cards that are not the dealer selected card (cards 200 and 202). Between these two cards, the dealer (turns face up) reveals (operation 108) the lower (weaker) one out of the two, which is the first card 200 which has a value of 3-spades. Thus, the player knows that card 202 (which is the player's selected card) must be higher (stronger) than 3-spades.

Figure 4A:
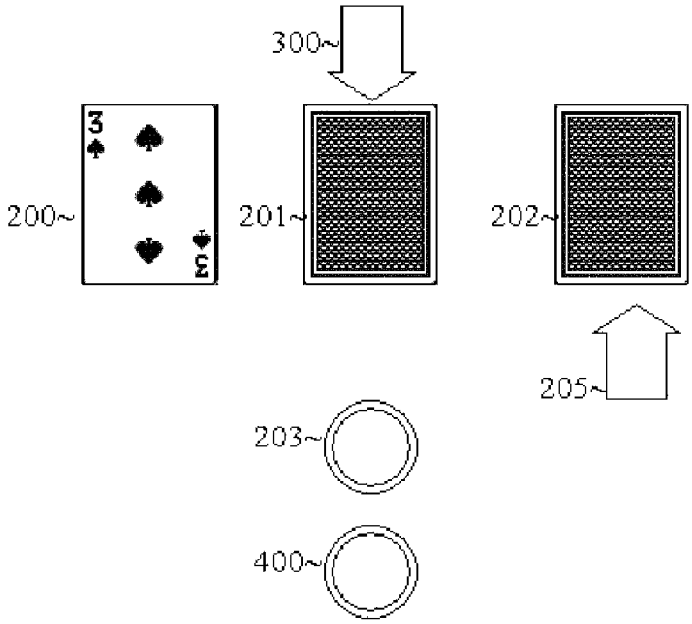
FIG. 4A is a drawing illustrated a fifth phase of an illustrative game, according to an embodiment.

FIG. 4A is a drawing illustrated a fifth phase of an illustrative game, according to an embodiment.

After viewing the revealed card 200, the player decides to place a raise wager 400 which can up be to two times the ante wager 203.

Figure 4B:
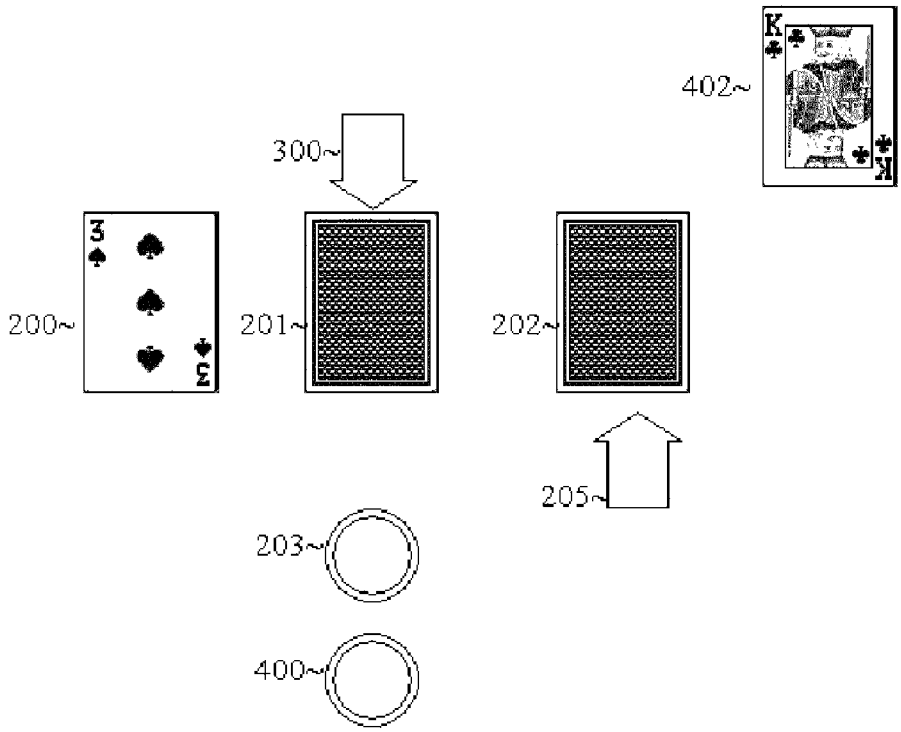
FIG. 4B is a drawing illustrated a sixth phase of an illustrative game, according to an embodiment.

FIG. 4B is a drawing illustrated a sixth phase of an illustrative game, according to an embodiment.

The dealer now deals or reveals a fourth (or "action") card 402 (operation 116), which turns out to be king-clubs. The action card can be used to resolve side bets as well as to determine whether or not the dealer switches the dealer selected card.

Figure 5A:
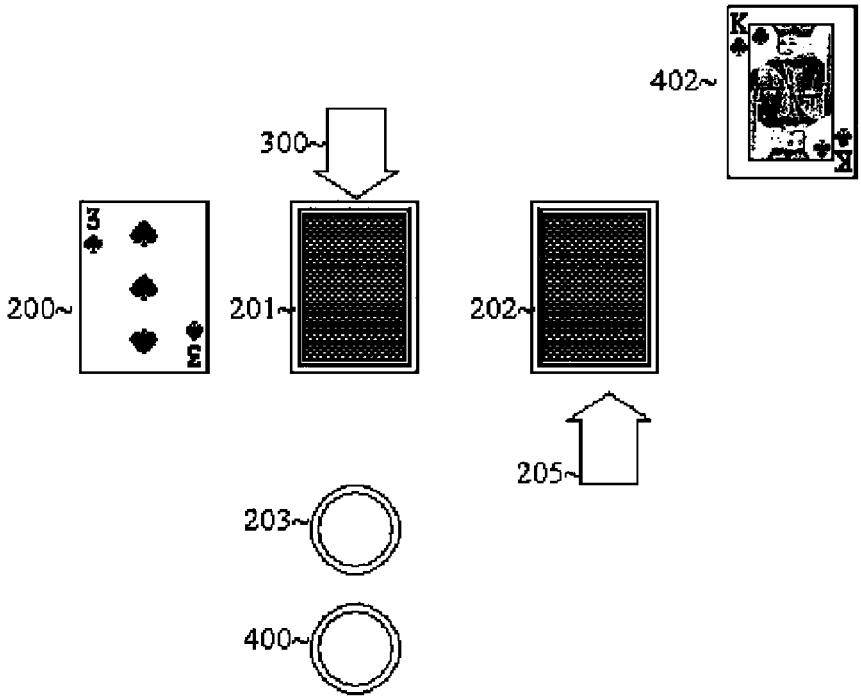
FIG. 5A is a drawing illustrated a seventh phase of an illustrative game, according to an embodiment.

FIG. 5A is a drawing illustrated a seventh phase of an illustrative game, according to an embodiment.

The dealer will determine whether to switch the dealer selected card based on characteristics of the action card 402 (operation 122).

In this case, since the color of the action card 402 is black (clubs are black), the dealer will not switch the dealer selected card (which is the middle card 201). If the color of the action card 402 was red, then the dealer would switch the dealer selected card to the last card 202 (operation 124) and the dealer would also move the dealer marker 300 to point to the last card 202 as well.

Thus, nothing changes from the phase in FIG. 5A to the later phase in FIG. 5B.

Figure 5B:
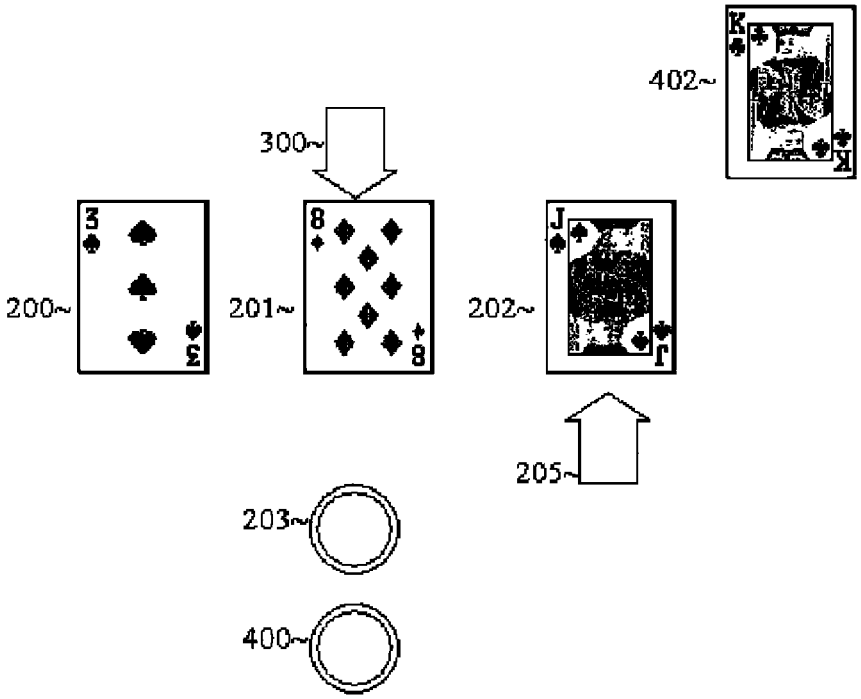
FIG. 5B is a drawing illustrated a final phase of an illustrative game, according to an embodiment.

FIG. 5B is a drawing illustrated a final phase of an illustrative game, according to an embodiment.

Now, all of the cards are revealed (operation 130). The highest (strongest) card is determined out of the three cards (3 spades, 8 diamonds, jack spades) which is the last card 202 (jack-spades). Since the player selected card (rightmost card) is the last card 202 (the strongest card), and the dealer selected card (middle) is not the highest (strongest) card out of the three cards (3 spades, 8 diamonds, jack spades), then the player wins the game. The player wins a 2:1 payout on both the ante wager 203 and the raise wager 400, although other payouts could be used in other embodiments of the game. The game is now over, and all cards can be collected, and a new game can begin. Alternatively, if the dealer selected card was the last card 202 (jack spades) and the player selected card was the middle card 300 (8 diamonds), then since the dealer selected card would be the strongest card out of the three cards and the player selected card is not the strongest card out of the three cards then the dealer would win and the player would lose both the ante wager and the raise wager.

A further example of the game will be presented. Scott places a $1 ante wager and the dealer deals three cards. Scott selects the first card as the player selected card and the dealer randomly selects the last card as the dealer selected card. The dealer then views the first two cards (since these are the remaining cards that are not the dealer selected card) and turns over the first card to reveal a 5-hearts. Since the player selected card is the first card, Scott has "busted." The dealer reveals an action card to be two-diamonds and then reveals the other two non-revealed cards. Since the action card is not a joker, Scott loses his $1 ante wager. If the action card was a joker, then Scott would win $2 (a 2:1 payout on the ante wager). Since Scott busted, the values of the other two cards out of the initial three do not matter.

Another example of the game will be presented. Rich places a $1 ante wager and the dealer deals three cards. Rich selects the middle card as the player selected card and the dealer randomly selects the first card as the dealer selected card. The dealer now peeks at the middle and third card (the two cards that are not the dealer selected card) and determines that the third card is the lowest of the two and turns over the third card to reveal a 7-spades. Rich has the option of placing a raise wager but declines. Now the dealer deals a fourth card (action card) which is a 10-hearts. Since the action card is red, the dealer now switches the dealer selected card from the first card to the middle card (the middle card being chosen because it is one of the remaining cards the dealer peeked at that was not revealed). So now both the player selected card and the dealer selected card are the middle card. The dealer now reveals the first card to be a queen-diamonds and the middle card to be a 10-clubs. The first card is higher (stronger) than the middle card since according to standard card ranks, queen is higher (beats) ten. Since Rich has not selected the highest card (the first card) and the dealer has not selected the highest card (the first) card then the game can be considered a "tie" and Rich pushes on the ante wager (operation 140). Since Rich did not place a raise wager he does not lose it but if Rich did place a raise wager he would have lost it (operation 140). If instead of this outcome, the first card was revealed to be the 10-clubs and the middle card was revealed to be the queen-diamonds, the outcome would still have been a tie resulting in operation 140, wherein Rich would push on his ante wager.

Figure 6A:
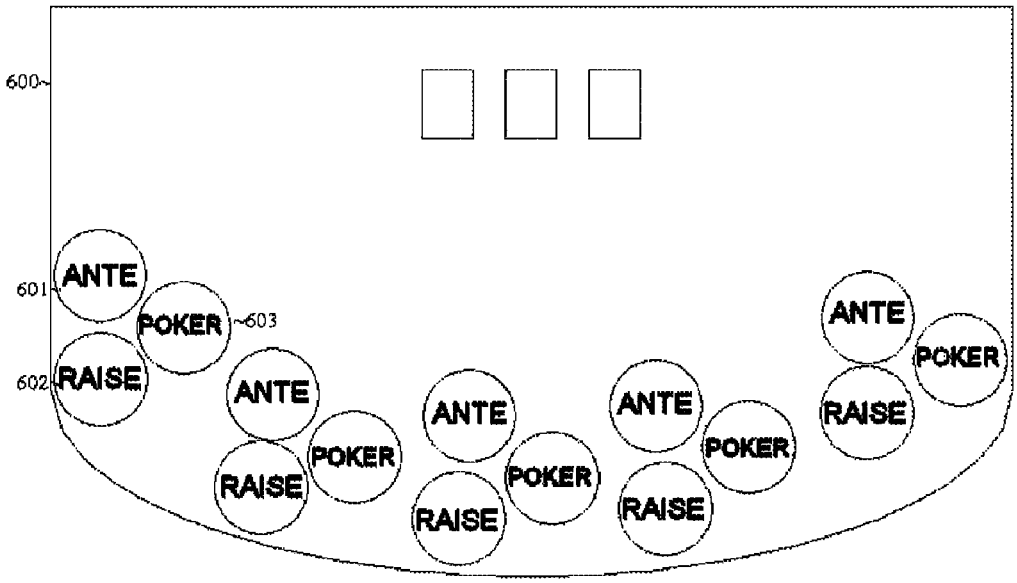
FIG. 6A is a drawing of an exemplary table layout to implement the game, according to an embodiment.

FIG. 6A is a drawing of an exemplary table layout to implement the game, according to an embodiment.

A standard gaming table 600 can be used, which comprises a table felt on top used as a playing surface for the cards and chips. Embedded on the felt are betting circles, such as an ante betting circle 601 used to place the ante wager, a raise betting circle 602 used to place the raise wager, and a poker betting circle 603 used to place the poker side wager. Other betting circles can be used as well such as additional betting circles for additional side bets.

The table illustrated in FIG. 6 can accommodate five simultaneous players, although of course a table can be designed to accommodate other numbers of players as well. Multiple players can play the game simultaneously, as in the fashion of blackjack and baccarat.

The decision of which card the player selects as the player selected card can be addressed in numerous ways on a multiplayer game. In one embodiment, the players can alternate (clockwise or counterclockwise) being the "decision player" for each new game. The decision player is the player which chooses which card of the initial cards is the player selected card, while all other players at the table will have to abide by this decision. Since this decision is purely random without strategy involved, it typically should not bother the other players at the table to let someone else make the decision. In another embodiment, each player can make their own decision as to which is the player selected card, and the dealer can use a particular marker for each player to mark the player selected card.

In a further embodiment, different betting circles can be offered (one for each card of the initial cards) and each player can place their wager on the appropriate betting circle in order to choose which card is the player selected card.

Figure 6B:
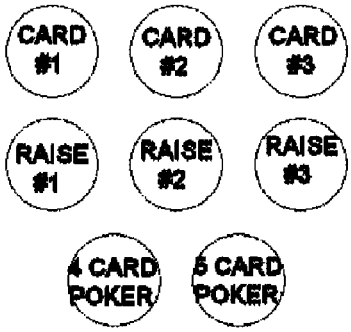
FIG. 6B is a drawing of a player's betting circles in an embodiment that uses betting circles to designate the player's selected card(s) and allows for multiple selected cards, according to an embodiment.

FIG. 6B is a drawing of a player's betting circles in an embodiment that uses betting circles to designate the player's selected card(s) and allows for multiple selected cards, according to an embodiment. Each player at a gaming table will have their own respective set of such betting circles as illustrated in FIG. 6B.

The player indicates which of the cards is the players selected card by placing the ante wager in the respective betting circle. For example, if the player wishes to select card 1 (the leftmost card) as the player selected card, the player would place his or her ante wager in the "card #1" betting circle. If the player wishes to select card 2 (the middle card) as the player selected card, the player would place his or her ante wager in the "card #2" betting circle. If the player wishes to select card 3 (the rightmost card) as the player selected card, the player would place his or her ante wager in the "card #3" betting circle.

If the player bet on the "card #1" betting circle and wishes to raise for the first card as the player selected card, the player can place his or her raise wager in the "raise #1" betting circle. If the player bet on the "card #2" betting circle and wishes to raise for the first card as the player selected card, the player can place his or her raise wager in the "raise #2" betting circle. If the player bet on the "card #3" betting circle and wishes to raise for the first card as the player selected card, the player can place his or her raise wager in the "raise #3" betting circle.

In the embodiment illustrated in FIG. 6B, the player can select as many cards as the player wishes as the player selected card, however the player would have to make an individual bet for each player selected card. Thus, the player can make 1-3 ante wagers, and would raise each respective player selected card that the player bet the ante wager on when the player wishes to do so.

There are also optional side bet betting circles such as "poker" side bet and "action card wager" side bet. Side wagers are ancillary wagers that are not won or lost by the main game (wagers that are not the ante/raise wagers) and can be optionally chosen by the casino and optionally played by the player.

Figure 6C:
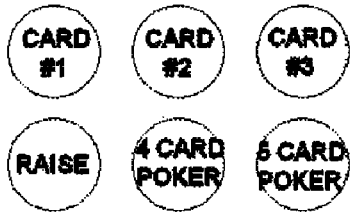
FIG. 6C is a drawing of a player's betting circles in a further embodiment that uses betting circles to designate the player's selected card, according to an embodiment.

FIG. 6C is a drawing of a player's betting circles in a further embodiment that uses betting circles to designate the player's selected card, according to an embodiment.

In this embodiment, the player is only allowed to make one ante wager on each game, and does so in the manner described in FIG. 6B, that is placing the wager in the appropriate betting circle for each card. Since the player can only make one ante wager at a time, only one "raise" betting circle is needed. In the embodiments shown in FIGS. 6B and 6C, the player marker 205 is not needed. There are also betting circles for two side bets, "4 card poker" and "5 card poker," although the house can offer any combination of side bets that the house wishes to offer.

Figure 7:
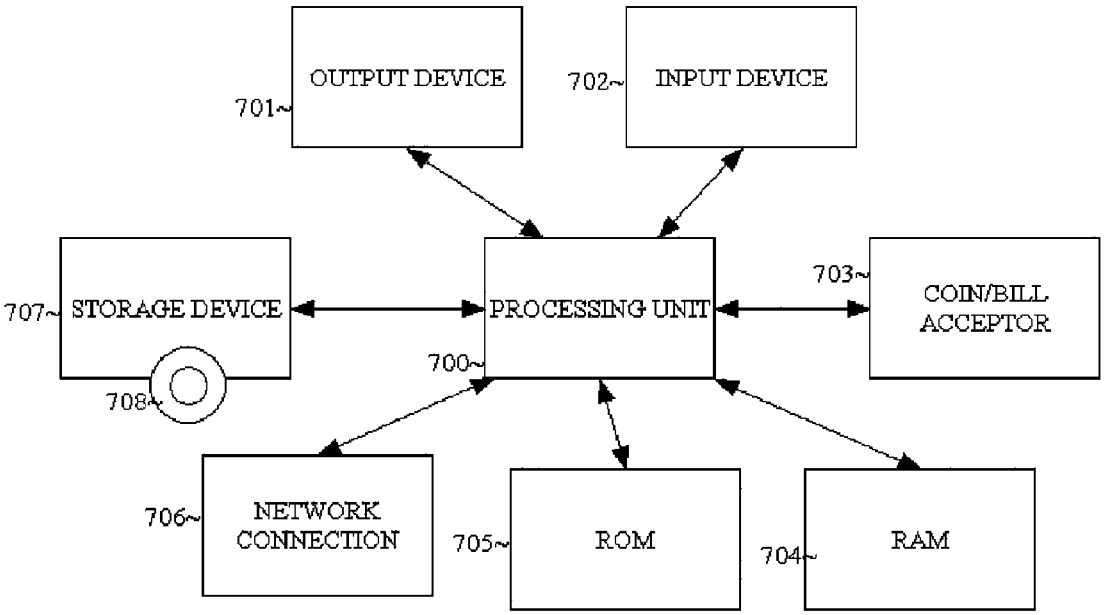
FIG. 7 is a block diagram illustrating hardware that can be used to implement an electronic gaming machine which can play the games described herein, according to an embodiment.

FIG. 7 is a block diagram illustrating hardware that can be used to implement an electronic gaming machine which can play the games described herein, according to an embodiment.

A processing unit 700 can be a microprocessor and any type of associated components (e.g., cache, bus, etc.) The microprocessor is connected (directly or indirectly) to an output device 701 (e.g., touchscreen, speakers, reels, CRT, etc.) an input device 702 (e.g., touchscreen, keyboard, mouse, etc.), a coin/bill acceptor 703 (which can also accept cashless tickets or electronically encoded payments cards), a RAM 704, a ROM 705, a network connection 706 (connecting the slot machine to any type of network such as a LAN, WAN, wifi, etc.), and a storage device 707 which can read programs and/or data to implement any of the methods described herein on a computer readable storage medium (e.g., CD-ROM, DVD, flash memory, hard disk, etc.) 708.

The game can also be played on an online (or Internet) casino by using a personal computer connected using a computer communications network (such as the Internet) to a server which is programmed to accept wagers and implement the methods described herein.

Any description of a component or embodiment herein also includes hardware, software, and configurations which already exist in the prior art and may be necessary to the operation of such component(s) or embodiment(s).

Further, the operations described herein can be performed in any sensible order. Any operations not required for proper operation can be optional. Further, all methods described herein can also be stored on a computer readable storage to control a computer.

The games and methods described herein can be played on a physical gaming table, using physical cards, and using cash or physical chips which can be immediately redeemable for cash at a casino cashier. Wagers can be made by physically placing chips on the gaming table and winning wagers are paid by the dealer paying the player with additional chips out of the dealer's chip box, while losing wagers (chips) are taking by the dealer and placed into the dealer's chip box.

Furthermore, all numbers, probabilities, returns, etc., enumerated herein are for illustrative purposes and no guarantee is made that such numbers are completely accurate.

The many features and advantages of the invention are apparent from the detailed specification and, thus, it is intended by the appended claims to cover all such features and advantages of the invention that fall within the true spirit and scope of the invention. Further, since numerous modifications and changes will readily occur to those skilled in the art, it is not desired to limit the invention to the exact construction and operation illustrated and described, and accordingly all suitable modifications and equivalents may be resorted to, falling within the scope of the invention.

What is claimed is:

1. A method for playing a casino card game, the method comprising:

executing instructions on an electronic processing unit to perform the following operations:

receiving a main wager from a player;

dealing a plurality of initial cards face down from the physical deck(s) of cards;

receiving, from the player, a selection of a player selected card out of the plurality of initial cards;

determining randomly and identifying a dealer selected card out of the plurality of initial cards;

revealing a revealed card, the revealed card being a weaker card among the plurality of initial cards that are not the dealer selected card;

determining randomly whether to switch the dealer selected card to another unrevealed card among the plurality initial cards;

revealing all of the plurality of initial cards;

determining whether the player selected card is a strongest card out of the plurality of initial cards and whether the dealer selected card is not the strongest card out of the plurality of initial cards, and upon both previous conditions being true then paying the main wager as a winning wager for the player.

2. The method as recited in claim 1, further comprising, determining whether the dealer selected card is the strongest card out of the plurality of initial cards and whether the player selected card is not the strongest card out of the plurality of initial cards, and if both prior conditions are true then taking the main wager from the player.

3. The method as recited in claim 2, further comprising, determining if the player selected card is not the strongest card out of the plurality of initial cards and whether the dealer selected card is strongest card out of the plurality of initial cards, and if both stated conditions are true, then the player pushes on the ante wager and loses any raise wager placed.

4. The method as recited in claim 1, wherein the plurality of initial cards are exactly three cards.

5. The method as recited in claim 1, wherein if the revealed card is the player selected card, then the player loses the ante wager unless an action card dealt has a predetermined characteristic.

6. The method as recited in claim 1, wherein after the revealing the revealed card, offering the player an option to place a raise wager which the player wins if the both previous conditions are true.

7. The method as recited in claim 6, wherein if the both prior conditions are true, then the raise wager loses for the player.

8. The method as recited in claim 1, wherein the determining randomly whether to switch the dealer selected card is determined by dealing an action card, and if the action card comprises a predetermined characteristic then the dealer selected card is switched.

9. The method as recited in claim 8, wherein the game is played with a standard deck of cards plus two jokers, and if the action card is a joker, then the player automatically wins the main wager and any raise wager placed.

10. An electronic gaming apparatus for playing a casino card game, the apparatus comprising:

a processing unit, configured to perform:

receiving a main wager from a player;

dealing a plurality of initial cards face down from deck(s) of cards;

receiving, from the player, a selection of a player selected card out of the plurality of initial cards;

determining randomly and identifying a dealer selected card out of the plurality of initial cards;

revealing a revealed card, the revealed card being a weaker card among the plurality of initial cards that are not the dealer selected card;

determining randomly whether to switch the dealer selected card to another unrevealed card among the plurality initial cards;

revealing all of the plurality of initial cards;

determining whether the player selected card is a strongest card out of the plurality of initial cards and whether the dealer selected card is not the strongest card out of the plurality of initial cards, and upon both previous conditions being true then paying the main wager as a winning wager for the player; and an output device outputting results of the processing unit.

11. The apparatus as recited in claim 10, further comprising, determining whether the dealer selected card is the strongest card out of the plurality of initial cards and whether the player selected card is not the strongest card out of the plurality of initial cards, and if both prior conditions are true then taking the main wager from the player.

12. The apparatus as recited in claim 11, further comprising, determining if the player selected card is not the strongest card out of the plurality of initial cards and whether the dealer selected card is strongest card out of the plurality of initial cards, and if both stated conditions are true, then the player pushes on the ante wager and loses any raise wager placed.

13. The apparatus as recited in claim 10, wherein the plurality of initial cards are exactly three cards.

14. The apparatus as recited in claim 10, wherein if the revealed card is the player selected card, then the player loses the ante wager unless an action card dealt has a predetermined characteristic.

15. The apparatus as recited in claim 10, wherein after the revealing the revealed card, offering the player an option to place a raise wager which the player wins if the both previous conditions are true.

16. The apparatus as recited in claim 15, wherein if the both prior conditions are true, then the raise wager loses for the player.

17. The apparatus as recited in claim 10, wherein the determining randomly whether to switch the dealer selected card is determined by dealing an action card, and if the action card comprises a predetermined characteristic then the dealer selected card is switched.

18. The apparatus as recited in claim 17, wherein the game is played with a standard deck of cards plus two jokers, and if the action card is a joker, then the player automatically wins the main wager and any raise wager placed.

* * * * *